United States Patent [19]

Weldon et al.

[11] Patent Number: 4,870,888

[45] Date of Patent: Oct. 3, 1989

[54] TRAVELING WAVE ACCELERATORS

[75] Inventors: William F. Weldon; Mircea D. Driga, both of Austin, Tex.

[73] Assignee: Board of Regents, University of Texas System, Austin, Tex.

[21] Appl. No.: 86,706

[22] Filed: Aug. 18, 1987

[51] Int. Cl.[4] ..... F41F 1/02

[52] U.S. Cl. ..... 89/8; 124/3

[58] Field of Search ..... 89/8; 124/3; 310/13, 310/14

[56] References Cited

U.S. PATENT DOCUMENTS

| | | | |
|---|---|---|---|
| 1,384,769 | 7/1921 | MacLaren | 89/8 |
| 2,224,505 | 12/1940 | Unger | 124/3 |
| 2,783,684 | 3/1957 | Yoler | 89/8 |
| 2,870,675 | 1/1959 | Salisbury | 89/8 |
| 4,200,831 | 4/1980 | Weldon et al. | 322/8 |
| 4,281,263 | 7/1981 | Virolleau et al. | 310/13 |
| 4,343,223 | 8/1982 | Hawke et al. | 89/8 |
| 4,459,504 | 7/1984 | Weldon et al. | 310/243 |

FOREIGN PATENT DOCUMENTS

| | | | |
|---|---|---|---|
| 448496 | 6/1936 | United Kingdom | 89/8 |

OTHER PUBLICATIONS

Burgess et al., "The 'Theta Gun,' a Multistage, Coaxial, Magnetic Induction Projectile Accelerator," Sandia National Laboratories Report No. SAND80-1881 (Nov. 1985). —

Burgess et al., "The Electromagnetic $\theta$ Gun and Tubular Projectile," Sandia National Laboratories, Report No. SAND80-1988.

Zucker et al., "The Design of a Repetitevely Pulsed Megajoule Dense-Plasma Focus," Lawrence Livermore Laboratory (Aug. 1, 1975).

Honig and Nunnally, "Multiple Resonant Railgun Power Supply," DOE Patent Application A6746479.

R. Kreutz, "Basis and Concepts for the Electromagnetic Acceleration of Pellets for Injection into Inertial Confinement Fusion Reactor Chamber," Kernforschungszentrum Karlsruhe (Feb., 1983).

Kolm and Miller "Electromagnetic Launchers and Guns, Phase I Final Report of the M.I.T. Group," Massachuetts Institute of Technology, Report AK-A143778 (Jun. 1980), pp. 1-7, 75-79.

Rashleigh and Marshall, "Electromagnetic Acceleration of Macroparticle to High Velocities," 49 J. App. Phys. (Apr. 1978), pp. 2540-2542.

Zucker and Bostick, "Theoretical and Practical Aspects of Energy Storage and Compression," Lawrence Livermore Laboratory Report UCRL-76091 (1975).

Cowan et al., "The Reconnection Gun," Sandia Laboratory Report SAND-86-0966C.

Hart et al., "Metallic Induction Reaction Engine," Air Force Office of Scientific Research Report AFOSR--TR-86-0933, AD-A173323.

M. D. Driga, W. F. Weldon, and H. H. Woodson, "Electromagnetic Induction Launchers," IEEE Trans. on Magnetics, vol. 22, No. 6, pp. 1453-1458, November, 1986 (presented at the 3rd Symposium on Electromagnetic Launch Technology, Ausin, Texas, Apr. 20-24, 1986).

Z. Zabar et al., "Design and Power Conditioning for the Coil-Gun" SPIE Symposium on Innovative Science and Technology, Los Angeles, CA, (Jan. 10-15, 1985).

*Primary Examiner*—Stephen C. Bentley

*Attorney, Agent, or Firm*—Arnold, White & Durkee

[57] ABSTRACT

Hypervelocity magnetic induction accelerators are disclosed which create a traveling magnetic wave behind a projectile without the use of sliding contacts or multiple triggered switches. Inductive and resistive parameters are established as a function of position along a stator coil to obtain the magnetic wave in response to the pulsed DC power source. The ratio of the resistance to the inductance is a decreasing function of position from the breech to the muzzle. In a preferred embodiment the stator coil has a multiplicity of stages, and the DC pulse is delayed by inductances to progressively excite the stages, and the current from the pulse is fed through resistances to provide voltages for diverting the current to the next stages. In an alternative embodiment the magnetic field from the stator coil progressively diffuses through a tapered conductive or ferromagnetic sleeve disposed in the stator coil.

12 Claims, 4 Drawing Sheets

TRAVELING WAVE ACCELERATORS

The U.S. Government may have rights in this invention pursuant to funding arrangements with the Department of Defense.

BACKGROUND OF THE INVENTION

1. Field of the Invention

This invention relates to coaxial magnetic induction accelerators. More specifically the invention relates to hypervelocity projectile accelerators which create a traveling magnetic wave behind the projectile but which do not require the use of sliding contacts or multiple triggered switches. In particular the invention relates to induction accelerators in which the inductive and resistive parameters relating to the excitation of an elongated stator coil are selected to obtain a traveling magnetic field gradient in response to a pulsed DC power source, without the use of active circuit elements.

2. Description of the Related Art

Thermodynamic guns are widely used and generally understood in a broad context. In an ordinary thermodynamic gun, a propellant burns to generate high pressure gas that pushes a projectile down a bore. While thermodynamic guns are used in many applications besides weapons—for example scientific and industrial applications—their use is somewhat limited because of the maximum velocities attainable. Physical limitations limit the projectile from such thermodynamic guns from reaching velocities much greater than two kilometers per second.

Electromagnetic guns have been widely investigated since World War II as an alternative to thermodynamic guns because of the possibilities of achieving projectile hypervelocities (greater than two kilometers per second). Hypervelocity guns and launchers ar under development for a wide range of applications, including anti-missile systems for strategic defense, impact fusion for nuclear energy production, and launching systems for satellites and spacecraft.

The development of electromagnetic guns has focused mainly upon two different classes of devices, the so-called "railguns," and the magnetic induction accelerators In either case a moving armature is propelled by a magnetic field linking it with stationary electrical conductors in the gun or launcher. In a railgun the stationary conductors are provided by a pair of elongated parallel-spaced rails, and the armature is disposed between the rails and electrically shorts the rails together so that the rails and the armature form an electrical circuit to a power source connected to the rails at a breech end of the gun. In a magnetic induction accelerator, a power source also excites stationary conductors and an electrical current also flows through the armature, but the currents in the stationary conductors and in the armature are not directly linked; instead, the two circuits are indirectly linked by magnetic induction. The degree of coupling between the stationary conductors or "stator" and the armature in a magnetic induction accelerator is quantified by a parameter known as the "mutual inductance" of the stator and armature circuits The railgun, being the simplest of the electromagnetic projectile accelerators, has enjoyed the most attention and success. In the early electromagnetic railguns, now known as "solid armature" railguns, the projectile was used as the armature. However, it was soon found that at high speeds around one kilometer per second, the rails and projectile were substantially damaged, possibly as a result of ohmic heating and/or internal forces. Further, increases in current flow tended to only increase rail and projectile gouging without an increase in projectile velocity. Thus, projectile velocities in excess of one kilometer per second were not practically attainable for "solid armature" railguns In the early 1970's, R. A. Marshall, J. P. Barber, and others at the Australian National University, Canberra, Australia, developed railguns using plasma armatures which could obtain hypervelocities and could make efficient use of high current, pulsed power supplies, such as homopolar generators. See, for example, S. C. Rashleigh and R. A. Marshall, "Electromagnetic Acceleration of Macroparticles to High Velocities," 49 *J. App. Phys.* 2540 (Apr. 1978). In recent years, however, research has revealed numerous problems associated with very high current plasma armatures. At the high currents necessary to obtain hypervelocities, rail erosion and metallic deposits from the plasma armature require the gun to be reamed or rebuilt after one or two shots. In this regard, plasma armature railguns require a sealed bore capable of withstanding the substantial electromagnetic forces generated during firing; the gaskets, seals and insulator materials associated with such bores have been a significant problem.

The application of plasma armature railguns is also constrained due to the fact that the projectile is accelerated using base pressures. Base pressure acceleration (such as is also used in thermodynamic guns) places severe design limits on the projectile. The projectile, for example, must be able to withstand the extreme temperature and pressure exerted at its base by the plasma armature.

A magnetic induction projectile accelerator known as the "coaxial induction" accelerator or "$\theta$gun" has been considered as a solution to the problems of the plasma armature or sliding contacts of the railgun. The $\theta$ gun has multiple coaxial stator coils for centering and driving a tubular copper projectile. In addition, the $\theta$ gun applies the propelling force along the entire length of the projectile. This has been said to allow much greater acceleration of large "fineness ratio" (i.e , large energy/cross section) projectiles for a given barrel pressure, allowing much shorter barrels for military application. See, for example, Burgess et al., "The Electromagnetic $\theta$ Gun and Tubular Projectiles", Sandia Nat. Lab. Report No. SAND80-1988.

Extensive experimental and theoretical analysis of the $\theta$ gun is included in Burgess et al., "The Theta Gun, a Multistage Coaxial, Magnetic Induction Projectile Accelerator", Sandia Nat. Lab. Report No. SAND85-1881 (November 1985). On page 59 the proclaimed advantages of the multistage coaxial magnetic induction mass accelerator are said to be that it is readily staged to become a distributed energy-input system, lack of physical contact between accelerator and projectile, high efficiency, simplified force containment due to its coaxial nature, and higher inductance gradient than a railgun. On page 60 the disadvantages are said to be that the accelerator must be staged, current pulses to each stage must be precisely synchronized, fast switching of high-voltages is required, and switching must be duplicated for each stage. Page 64 says that in the case of rotating machinery power supplies, intermediate power conditioning is required to produce current pulses of rise time short compared to the projectile transit time through a coaxial stage (compared to a railgun), and this power conditioning is very wasteful of energy. Page 64 says that switching duplication is a self-evident, unqualified disadvantage, particularly in the case of a many-staged system with high-velocity projectiles where power conditioning is required. Page 65 further says that since the velocity increase per stage is small, many stages are required to achieve high projectile velocity, and this is very disadvantageous given the complexity of each stage.

SUMMARY OF THE INVENTION

Accordingly, the overall goal of the invention is to overcome the reputed disadvantages of the multistage coaxial magnetic induction projectile accelerator, including those disadvantages previously believed to be self-evident and unqualified.

Specifically, the primary object of the invention is to provide a coaxial magnetic induction projectile accelerator capable of being powered by a rotating machinery power supply without intermediate power conditioning.

Another object of the invention is to provide a many-staged coaxial magnetic induction projectile accelerator without switching duplication that is capable of firing a high-velocity projectile. A related object is to provide such an accelerator that can be powered by a rotating machinery power supply without power conditioning that is excessively wasteful of energy.

Still another object of the invention is to provide a many-staged coaxial magnetic induction projectile accelerator that is capable of achieving high projectile velocity and has individual stages that are not complex.

Briefly, in accordance with the invention, a hypervelocity projectile accelerator creates a traveling magnetic wave behind a projectile without using sliding contacts or multiple triggered switches. In particular inductive and resistive parameters relating to the excitation of an elongated stator coil are selected to obtain a traveling magnetic field gradient in response to a pulsed DC power source. The inductive and resistive parameters are built into the construction of the stator coil or are provided by passive circuit elements. Hypervelocities of about two kilometers per second are obtainable by appropriately constructing the stator coil with a resistance that decreases from the breech to the muzzle, and an inductance which increases from the breech to the muzzle. Such a device can be powered by a high-voltage homopolar generator without using intermediate power storage. Higher velocities are obtainable from a fast high-gradient traveling wave generated by a many-staged system excited by a high-voltage DC pulse and using passive non-linear components.

BRIEF DESCRIPTION OF THE DRAWINGS

Other objects and advantages of the invention will become apparent upon reading the following detailed description and upon reference to the drawings in which.

Figure 1:
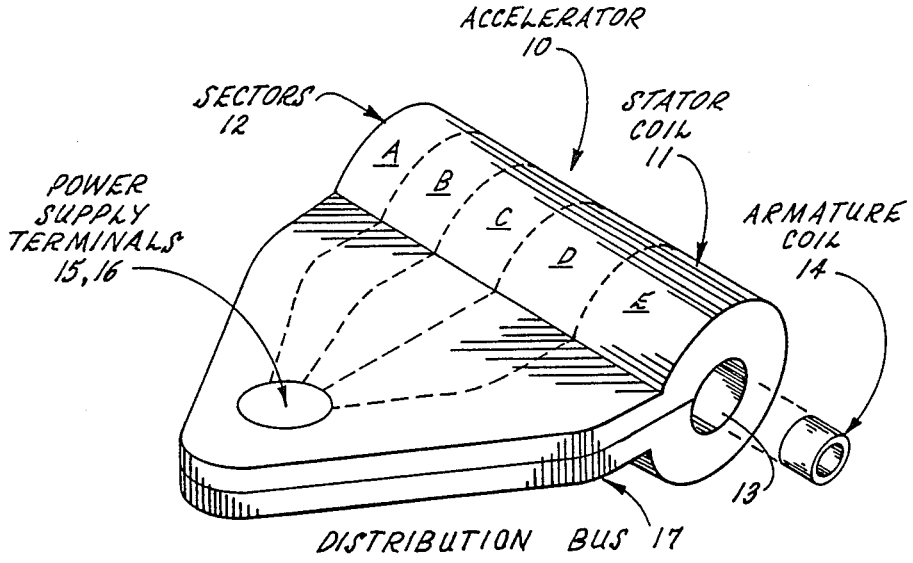
FIG. 1 is a pictorial diagram of a traveling wave accelerator of the present invention incorporating a number of stages or sectors.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

The coaxial induction accelerator, in principle, offers electromagnetic acceleration without plasmas or sliding contacts but, in practice, has required the replacement of these technology problems with others equally demanding. The simplest such accelerator comprises a stator coil having a set of discrete coil sections, and an armature that is simply a shorted turn. The armature carries either a persistent or induced current causing it to have a magnetic dipole moment. As the armature coil passes through each stator coil section, the stator coil section is pulsed, thereby inducing current in the armature coil and propelling the armature coil along the axis of the stator coil.

Although simple in principle, the discrete coil accelerator is difficult to implement at serious power levels and velocities because of the necessity to sense the position of the armature actively and to switch on each stator coil. At low power levels, such a discrete coil accelerator can be built using a separate capacitor bank for each section, a closing switch for connecting the stator coil section to its respective capacitor bank at the proper instant in time, and a crowbar switch for shorting the stator coil section once it has been fully energized by the capacitor bank. High energy capacitor banks, however, are relatively bulky and expensive. It is desirable, therefore, to replace the capacitor banks with either an inductive or electromechanical energy storage device. It is, however, not economical to replace each of the capacitor banks with a separate inductive or electromechanical storage device, since inductive storage devices typically require opening switches which are difficult to synchronize, and the duplication of such inductive or electromechanical storage devices again leads to considerable bulk and expense as in the case of capacitor banks.

Turning now to FIG. 1, there is shown a traveling wave accelerator generally designated 10 which is capable of being powered by a pulsed DC power supply such as an inductive energy store or a rotating electromechanical generator. The accelerator 10, however, is entirely passive and does not require sensing or switching, yet it sequentially energizes a stator coil 11 having a multiplicity of stages or sectors 12 designated A to E. For receiving an armature coil or projectile 14, the stator coil 11 is elongated and defines a central bore 13.

In accordance with an important aspect of the present invention, the stator coil 11 is made of different materials having electrical conductivities which increase from sector A to sector E. In other words, the resistance associated with the stator coil decreases in the direction from the breech (at sector A) to the muzzle (at sector E). The sectors may be further constructed in such a way that they have associated with them inductances which increase from sector A to sector E.

For connecting the sectors 12 to a common pair of power supply terminals 15, 16 the accelerator 10 has a distribution circuit 17.

In accordance with an important aspect of the present invention, the accelerator 10 generates a traveling wave of magnetic gradient in response to a DC voltage applied to the power supply terminals 15, 16. As the voltage is applied to the terminals, the current first diffuses or flows into the first sector A, which is the most resistive material. As time passes, the current progressively diffuses or flows into the more conductive sectors creating a magnetic wave in the bore 13 which travels from sector A toward sector F. Moreover, as the current diffuses or flows into the more conductive sections, the current in the less conductive sections is reduced or shifted by resistive current division. The velocity and intensity of the traveling magnetic wave in the bore 13 can be controlled by selection of the cross-section, length and conductivity of each coil sector as well as by selecting the voltage applied to the power supply terminals.

Figure 2:
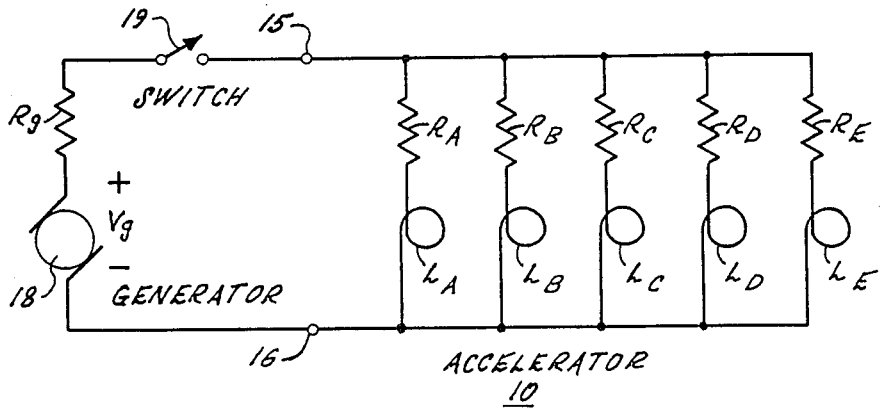
FIG. 2 is a schematic diagram of an electrical circuit showing how the stages of the accelerator of FIG. 1 are connected by a distribution circuit to a pulsed DC power supply.

Turning now to FIG. 2, there is shown a schematic diagram of the traveling wave accelerator 10 being powered by a homopolar generator 18. An important advantage of the traveling wave accelerator 10 of the present invention is that it does not require a high frequency power supply. Since the power supply pulse width is on the order of the accelerator launch time, the power supply can be a homopolar generator/inductor, a high voltage homopolar generator, or a low frequency compulsator (about 20 Hz) as are used to drive railguns. A suitable homopolar generator is described in Weldon et al., U.S. Pat. 4,459,504 issued July 10, 1984. The compulsator (i.e., compensated pulsed alternator) is described in Weldon et al., U.S. Pat. No. 4,200,831 issued Apr. 29, 1980.

High voltage homopolar generators are currently being developed which use superconducting magnets for excitation. A four rotor homopolar generator with superconducting excitation coils, for example, may provide a terminal voltage $V_g$ up to 500 volts. As shown in FIG. 2, such a generator 18 can drive the accelerator 10 directly without an intermediate storage inductor or an opening switch. Instead, the generator 18 is connected to the accelerator 10 via a closing switch 19 which is, for example, an explosively driven switch. The generator 18 is shown having associated with it a certain value of series resistance $R_g$, which limits the maximum current obtainable from the generator.

Figure 3:
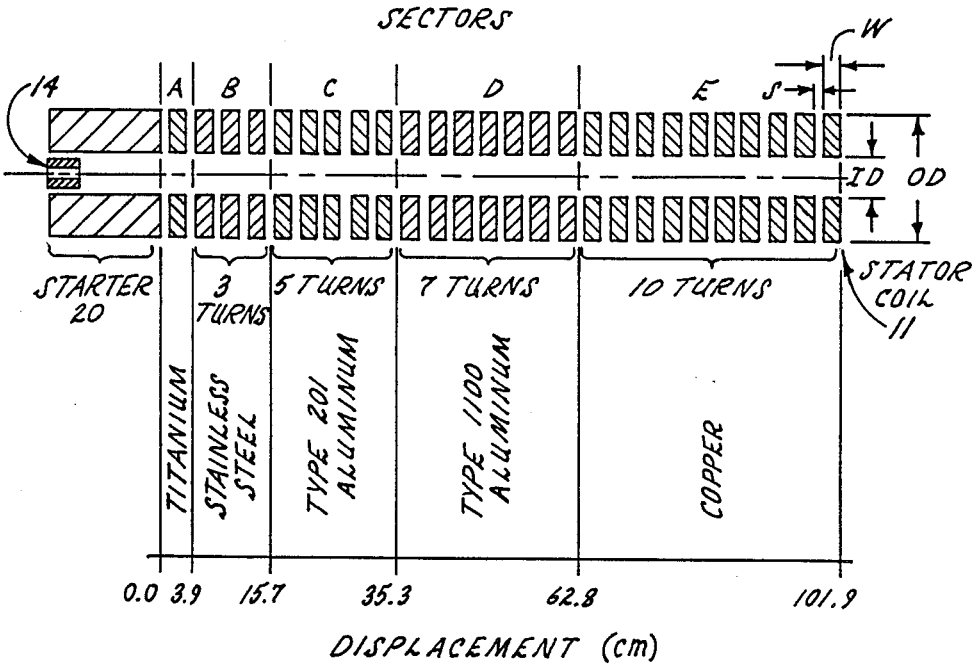
FIG. 3 is a schematic diagram, in cross-section, of a preferred form of the stator coil for the traveling wave accelerator of FIG. 1.

Turning now to FIG. 3, there is shown a cross-section of the stator coil 11 for a specific embodiment of the accelerator shown in FIGS. 1 and 2. The specific embodiment is designed for accelerating a mass of at least one hundred grams to a velocity of at least 2 km/s. Also shown in FIG. 3 is a starter coil 20 for inducing a 1 MA (megaampere) current in the single turn armature coil 14 and to insert the armature into the stator coil 11 at a relatively low velocity. Alternatively, the armature 14 could be injected into the stator coil using a gun powered by compressed gas or a chemical explosive, and a current could be induced into the armature 14 solely by induction from the first sector A of the stator coil.

The five sectors A–E of the stator coil 11 are described in the following Table I.

TABLE II

| | Stator Coil Properties | | | | |
|---|---|---|---|---|---|
| Sector | Material | % Conductivity (relative to Copper) | # of turns | Axial conductor length (cm) | Total axial length (cm) |
| A | titanium type 6AL—4V | 0.5 | 1 | 2.8 | 3.9 |
| B | stainless steel | 9.9 | 3 | 8.4 | 11.8 |
| C | aluminum type 201 | 27.0 | 5 | 14.0 | 19.6 |
| D | aluminum type 1100 | 55.0 | 7 | 19.6 | 27.5 |
| E | copper | 100.0 | 10 | 28.0 | 39.1 |

The basic dimensions of each turn are 4.5 cm ID, 8 cm OD, and 2.8 cm W. The peak axial magnetic flux density in the stator coil is about 15.4 T.

The resistance and inductance of the sectors A-E of the stator coil 11 are selected so that the peak current in each sector occurs just after passage of the projectile 14 along its intended trajectory. For instructional purposes or for a very rough "first-pass" design, the projectile 14 can be assumed to undergo uniform acceleration from the breech to the muzzle of the stator coil 11. Assuming then that the armature coil 14 is uniformly accelerated from 0 to 2000 m/s over a distance of about 1 m, then the transit time is obtained by dividing the distance of 1 m by the average velocity of 1000 m/s, giving a transit time of 1000 us. For uniform acceleration the displacement of the armature coil 14 is a parabolic function of time, as can be seen by comparing the linear displacement axis of FIG. 3 to a corresponding nonlinear time scale in FIG. 4.

Figure 4:
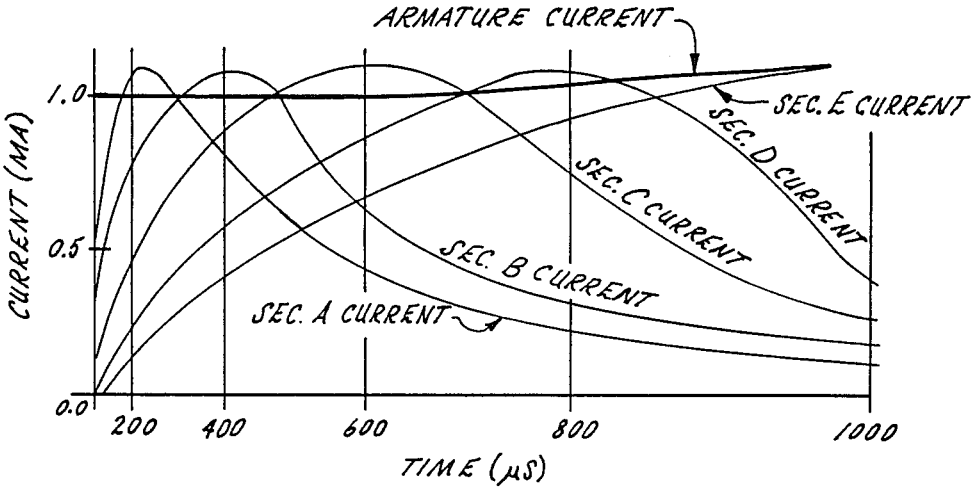
FIG. 4 is a graph of the current through the sectors of the stator coil shown in FIG. 3 and the current through the armature coil or projectile propelled by the stator coil.

The time of propagation through each sector is obtained by dividing the total transit time by the number of sectors. For five sectors, the transit time through each sector is 1000/5 or 200 microseconds per sector. As shown in FIG. 4, 200 microsecond intervals are plotted on the parabolic time scales to determine corresponding displacements defining the endpoints of the sectors.

The resistance and inductance of each sector are selected so that the current in each sector is a maximum when the stator coil reaches the end of the sector nearest the muzzle.

Returning for a moment to FIG. 2, it is seen that the circuit has certain characteristic time constants set by the inductances L and the resistances R. In accordance with an important aspect of the present invention, the resistances R of the sectors A–E decrease from the breech end to the muzzle end, and the inductances L of the sectors A–E increase from the breech end toward the muzzle end. Due to this fact, after the switch 19 is closed, current from the generator 18 first primarily flows through the sector A, and then progressively shifts from sector A to sector B, from sector B to sector C, from sector C to sector D, and finally from sector D to sector E.

Given specific values for the parameters shown in FIG. 2, the current through each sector or branch of the circuit is readily determined by a computer program for circuit analysis. However, for the sake of illustration, assume that the resistance R is a decreasing function of position such as $R_x=r/x$, and the inductance L is an increasing function of position such as $L_x=1x$. Further, for the purpose of illustration, the simplifying assumption can be made that the pulse from the power supply has a predominant frequency component $\omega=2.5/t$ at a time t after the pulse is applied. Then at a time t the current will be a maximum at the position x having the minimum magnitude of impedance, since the impedances of the sectors are all connected in parallel to the power supply terminals. The magnitude of the impedance is $\sqrt{R_x^2+\omega^2L_x^2}$. By substituting the formulas for Rx and $L_x$ in terms of x, then it is seen that for any given $\omega$ there will be a position x for which the impedance is a minimum; specifically, the minimum occurs where $x=\sqrt{r/\omega l}$. Therefore, given the time t of 200, 400, 600, 800 and 1000 microseconds, corresponding values of the frequency $\omega$ can be computed and ratios of R to L can be selected so that the respective sectors have their minimums of impedances corresponding at the required times.

This analysis in the frequency domain, of course, only gives a very rough approximation of where the optimum values are. Computer analysis of the step response of the circuit can be used for optimizing the component values. For example, the currents for the sectors of the specific example are shown in FIG. 4. The values of the resistance and inductance have been selected to obtain good power transfer from the generator and to obtain well defined current maximums at the desired times.

The dimensions and numbers of turns in the coil sectors determine the inductances. Assuming that the stator coil 11 is a perfect solenoid, for example, the inductance of a single turn coil segment is given by $L=\mu_0A/2X$, where A is the internal cross-sectional area of the solenoid and X is the length of a single turn coil segment. The internal diameter ID of 2.25 cm and a length of 3.35 cm gives an inductance of about 30 nH. The inductance of the single turn coil segment would be about 20 nH if it were completely isolated from the other turns in the solenoid. In practice each single turn of the stator coil as shown in FIG. 3 will have an inductance of about 25 nH. Due to this value of inductance, the magnetic induction field in the bore of the stator coil is about 15 T for a current I of about 1 MA.

Figure 5:
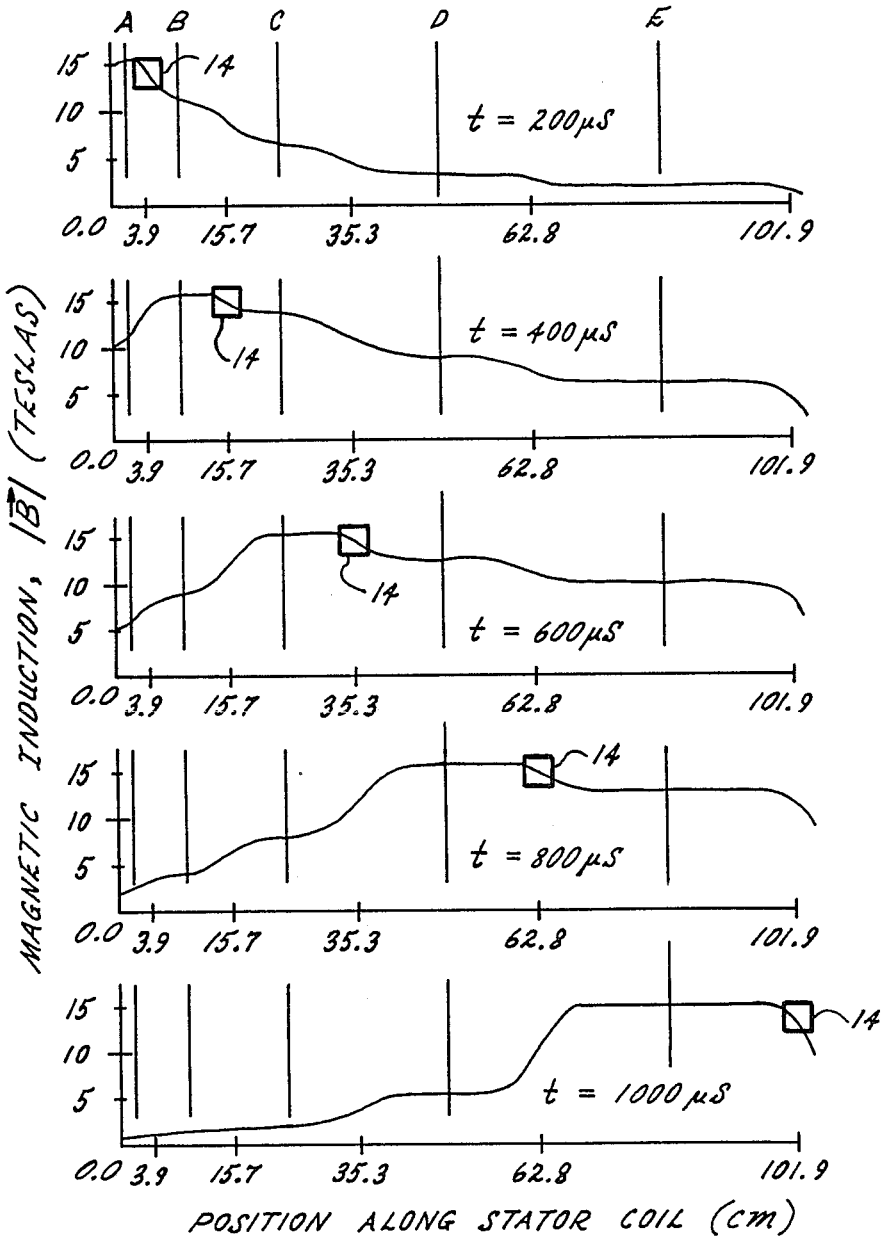
FIG. 5 shows graphs of the traveling magnetic wave in the stator coil at various times during the launching of the projectile.

Turning now to FIG. 5, there are shown graphs of the magnitude of the magnetic induction field as a function of position at 200 microsecond intervals. In other words, the traveling magnetic wave is shown for each of the points in time at which the current is a maximum in respective ones of the sectors. The position of the projectile or armature coil 14 is also shown at these points in time. As is evident from FIG. 5, the stator coil 11 has been designed so that the projectile or armature coil 14 is accelerated by the maximum gradient of the magnetic induction field having a magnitude which decreases toward the muzzle end of the stator coil.

Figure 6:
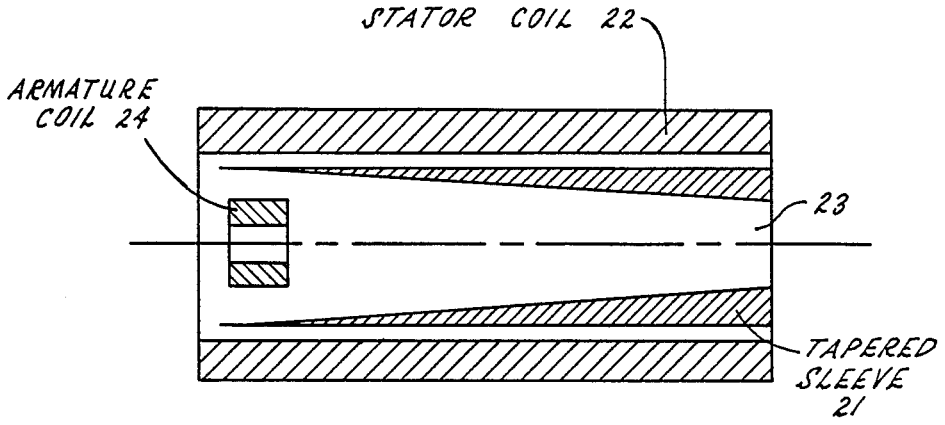
FIG. 6 is a schematic diagram, in cross-section, of an alternative embodiment of the invention incorporating a tapered sleeve disposed within the stator coil.

Turning now to FIG. 6, there is shown an alternative embodiment of the present invention which uses a tapered sleeve 21 disposed in the bore of a monolithic stator coil 22 for generating a traveling magnetic wave in response to a DC pulse applied to the stator coil. The sleeve 21 has a minimum thickness at the breech end of the stator coil, and has a maximum thickness at the muzzle end. Moreover, the tapered sleeve is cylindrical so as to shield the central portion 23 of the bore from the magnetic field generated by the stator coil 22. Therefore, when the DC pulse is applied to the stator coil 22, the magnetic field from the current in the stator coil must diffuse through the tapered sleeve 21 to reach the bore 23. The tapered sleeve 21 is, for example, made up of an electrically conductive or ferromagnetic material.

Since the sleeve is tapered, the magnetic field first fills the bore 23 at the breech end of the stator coil, where it begins to accelerate an armature coil 24. The magnetic field continues to diffuse through the tapered sleeve 21 at approximately a constant velocity so that a wave of magnetic induction is generated traveling from the breech to the muzzle.

In order to increase the gradient of the traveling magnetic wave, saturable ferromagnetic material can be used in the traveling wave accelerators of the present invention. Saturable ferromagnetic material can be used for the tapered sleeve 21 in FIG. 6. Alternatively, the conductors of the sections of the stator coil 11 in FIG. 1 can be embedded in varying amounts of saturable ferromagnetic material to provide the increasing inductance toward the muzzle. In either case the nonlinear effect provided by the saturable magnetic material would cause the magnetic field in the bore to increase slowly at first when the ferromagnetic material is in its unsaturated state, and then rise rapidly after the material saturates. In other words, the saturable magnetic material provides a time delay for the DC pulse to be fully applied to the stator coil at a location toward the muzzle. In particular, the saturable material provides an increased inductance L up to the time that the current reaches a saturation value $I_s$. For an applied voltage V, the time delay is given by $t_d=LI_s/V$.

Figure 7:
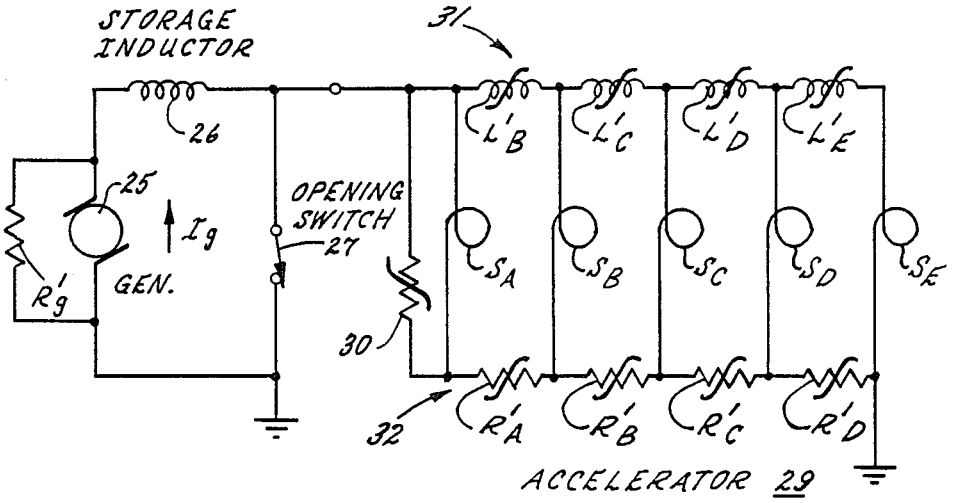
FIG. 7 is a schematic diagram of an electrical circuit which is a "Dual" of the circuit in FIG. 2 end which corresponds to another embodiment of the invention.

Turning now to FIG. 7, there is shown a schematic diagram of a circuit that is a kind of "dual" of the circuit in FIG. 2. In general, a dual of a circuit is obtained by replacing the nodes of the circuit with branches, and replacing the branches of the circuit with nodes. In other words, circuit elements that were connected in series become connected in parallel, and circuit elements that were connected in parallel become connected in series. The dual circuit in FIG. 7 could be useful for a traveling wave accelerator having an increased number of stages for achieving an increased projectile velocity. The dual circuit also illustrates how a low voltage homopolar generator 25 is used as a power supply.

In order to obtain a relatively high voltage DC pulse from the low voltage homopolar generator 25, there is provided a storage inductor 26 and an opening switch 27. Prior to firing the projectile, the opening switch 27 is closed and the homopolar generator 25 is actuated so that current flows from the generator to the storage inductor 26. This current increases to a maximum value $I_g$ at which the storage inductor 26 is fully charged. The homopolar generator is shown having a parallel resistance $R_g$, which limits the maximum voltage obtainable from the generator.

To fire the projectile, the switch 27 is opened to break the direct circuit between the storage inductor and the generator. Due to the inductance of the storage inductor, a voltage is generated across the opening switch. This voltage assumes whatever value is required to conduct the current from the storage inductor. Therefore, very high voltages can be generated, depending upon the ability of the opening switch to break the circuit. For single shot applications of the accelerator, the opening switch is preferably an explosive switch. For repetitive operation, a mechanical switch could be used that would be actuated by the same mechanism which injects the armature coil into the stator coil. For example, if the armature coil is initially accelerated by an explosive charge, the explosive charge could also activate circuit breaker contacts of the opening switch. The armature coil itself could bridge the contacts of the opening switch prior to firing. In this regard, the opening switch could be configured as a railgun for providing an initial acceleration of the armature coil.

The first sector $S_A$ of the accelerator 29 is charged at a rate determined by the voltage generated across the opening switch 27. This voltage depends on how fast the switch opens, and in the case of a mechanical switch it may fluctuate due to arcing between the switch contacts. In order to limit this voltage to a constant value and also to suppress arcing at the switch contacts, a surge suppressor 30 could be connected in shunt relation with respect to the opening switch 27 and the first sector $S_A$. The surge suppressor provides a nonlinear resistance which is relatively small until a threshold voltage is reached. Low voltage surge suppressors can be provided by a reverse biased rectifier such as a selenium rectifier or a germanium or silicon diode. High voltage surge suppressors are commonly made of a silicon-carbide ceramic material such as thyrite.

As shown in FIG. 7, the sectors $S_A$–$S_E$ of the stator coil are wired to bus bars generally designated 31 and 32 which include the inductances and resistances for sequentially energizing the sectors. Specifically, the bus bar 31 is provided with a series of inductances $L_B'$–$L_E'$, and the bus bar 32 is provided with series resistances $R_A'$–$R_D'$. Moreover, these inductances and resistances are shown as nonlinear inductances and resistances so that the accelerator is in the form of a pulse compression line. The theory of operation of various kinds of pulse compression lines, such as the "Melville" line, are described in Zucker and Bostick, "Theoretical and Practical Aspects of Energy Storage and Compression," Lawrence Livermore Laboratory Report UCRL-76091 (1974).

As in shown in FIG. 4, without using nonlinear inductances, the sector E nearest to the muzzle of the stator coil is charged with current at a lower rate than the sector A nearest the breech. This reduces the gradient of the magnetic field in the bore of the stator coil. Without using nonlinear resistances, the current in the sectors near the breech have a rate of decay which occurs at a decreasing rate. These "tails" in the sector current tend to reduce the current flow to sectors closer to the muzzle.

By using nonlinear inductances in the accelerator 29 of FIG. 7, the current rise in each sector can be delayed until the required time, and at the required time the current rise can be very rapid. By using nonlinear resistances in the accelerator 29 of FIG. 7, the current in the sectors nearer to the breech will decay at a constant rate so that the current is more completely shifted to the sectors nearer to the muzzle. When the opening switch 27 opens, for example, the sector $S_A$ is charged at a rate determined by the threshold voltage of the surge suppressor 30. At this time the saturable inductance $L_B'$ is relatively high due to the fact that it is in an unsaturated condition. Sometime after the sector $S_A$ is fully charged with the current from the storage inductor 26, the inductor $L_B'$ saturates so that the next sector $S_B$ charges at a rapid rate. When the sector $S_B$ becomes charged the sector $S_A$ becomes discharged due to a voltage drop through the nonlinear resistance $R_A'$. In this same fashion, the current from the storage inductor 26 is progressively shifted from the sector $S_B$ to the sector $S_C$, and so on until the current is finally shifted to the sector $S_E$ at the muzzle.

In practice the bus bars including the nonlinear inductances and resistances could be sandwiched and clamped between parallel spaced ground planes. The nonlinear inductances could be provided by sections of bus bar wound with many turns of a thin strip of ferromagnetic material such as nickel iron alloy or amorphous iron known as "metal glass." The windings should be separated with a thin strip of insulating material to prevent eddy loss which would limit the frequency response of the inductances. Nickel iron alloy having a very high inductance and fast saturation is known as mumetal and is sold under trademarks such as Permalloy and Hypersil. The nonlinear resistances $R_A'$–$R_D'$ would have the same construction as the surge suppressor 30.

In view of the above there have been provided traveling wave accelerators which overcome the reputed disadvantages of the multistage coaxial magnetic induction projectile accelerator. These accelerators are capable of being powered directly by a rotating machinery power supply such as a homopolar generator with superconducting excitation coils. Low voltage homopolar generators could also be used with very simple intermediate power conditioning provided by a storage inductor and an opening switch. A five stage coaxial magnetic induction projectile accelerator has been described which fires a projectile to a hypervelocity of 2 kilometers per second without the use of duplicate switches and without any intermediate power conditioning. Accelerators including a very large number of stages and exploiting nonlinear effects could achieve even higher projectile velocities without the use of active components and without excessive complexity.

What is claimed is:

1. A magnetic induction projectile accelerator of the kind having a stator coil including a number of stages, said stages being aligned in sequence along an axis from a breech to a muzzle, said accelerator further including a distribution circuit connecting said stages in parallel to a common pulsed DC electrical power supply during acceleration, said steps stages sequentially receiving current from said power supply to form a magnetic wave having a magnitude decreasing along said axis toward said muzzle and propagating along said axis toward said muzzle, wherein the improvement comprises each electrical circuit including a respective one of the stages and connecting the respective stage in parallel to the pulsed DC electrical power supply during acceleration having a respective impedance including a resistance component and an inductance component, wherein the ratio of the resistance to the inductance for the respective stages is a decreasing function of the position of the respective stage along said axis, said ratio being a maximum for the stage nearest the breech and being a minimum for the steps nearest the muzzle.

2. The accelerator as claimed in claim 1, wherein the variation of the ratio of resistance to inductance is provided by variation in the construction of said stages.

3. The accelerator as claimed in claim 1, wherein the variation of the ratio of resistance to inductance is provided by different paths through said distribution circuit.

4. The accelerator as claimed in claim 1, wherein the inductance for some of the respective stages is provided by saturable ferromagnetic material.

5. A magnetic induction projectile accelerator of the kind having a stator coil including a number of stages, said stages being aligned in sequence along an axis from a breech to a muzzle, said accelerator further including a distribution circuit connecting said stages in parallel to a common pulsed DC electrical power supply during acceleration, said stages sequentially receiving current from said power supply to form a magnetic wave having a magnitude decreasing along said axis toward said muzzle and propagating along said axis toward said muzzle, wherein the improvement comprises each electrical circuits including a respective one of the stages and connecting the respective stage in parallel to the pulsed DC electrical power supply during acceleration having a respective impedance including a resistance component and an inductance component, wherein the ratio of the resistance to the inductance for the respective stages is a decreasing function of the position of the respective stage along said axis, said ratio being a maximum for the stage nearest the breech and being a minimum for the stages nearest the muzzle, and wherein the resistance for the respective stages is a decreasing function of the position of the respective stage along said axis and is a maximum for the stage nearest the breech and a minimum for the stage nearest the muzzle, and wherein the inductance for the respective stages is an increasing function of the position of the respective stage along said axis and is a minimum for the stage nearest the breech and a maximum for the stage nearest the muzzle.

6. The accelerator as claimed in claim 5, wherein the stages are respective single-layer helical coils having different numbers of turns and being made of respective materials of different electrical conductivity.

7. A method of creating a traveling wave of magnetic gradient by progressively energizing a series of sequentially disposed electromagnetic coils in response to a DC pulse, said method including the steps of feeding said DC pulse through inductances to provide progressive delays at which said pulse reaches the electromagnetic coils, and once reaching said electromagnetic coils, feeding the current from said pulse through resistance in series with said electromagnetic coils, said resistances providing a voltage drop in response to said current, and applying said voltage drop to the inductances and the next coils in said series, said voltage drop diverting the current to the next coils in said series.

8. The method as claimed in claim 7, wherein said inductances are provided by saturable ferromagnetic material.

9. The method as claimed in claim 7, further comprising the step of launching a projectile by inductively linking said projectile to said series of electromagnetic coils.

10. A coaxial magnetic induction projectile accelerator of the kind having an elongated stator coil defining a central bore and having a muzzle end, said bore receiving a projectile having a magnetic dipole moment during acceleration, said accelerator further including a distribution circuit connecting said stator coil to an electrical power supply during said acceleration, said stator coil creating a magnetic field along said bore decreasing in magnitude toward said muzzle end when said stator coil is energized by said power supply so that said projectile is propelled along said bore to exit from said muzzle end by virtue of the interaction of said magnetic field gradient and said dipole moment, wherein the improvement comprises means for establishing inductive and resistive parameters that are a function of position along the length of said stator coil so that said magnetic field becomes a traveling wave traveling along said bore toward said muzzle end in response to an energizing pulse from said power supply, wherein said means for establishing the inductive and resistance parameters includes means for establishing the impedance of said stator coil that determines the current flowing from said power supply through said coil as a function of position along the length of said stator coil, and wherein said means for establishing the impedance includes means for establishing a resistance that is a decreasing function of position toward said muzzle end, and means for establishing an inductance that is an increasing function of position toward said muzzle end.

11. The accelerator as claimed in claim 10, wherein said means for establishing a resistance comprises electrically conductive materials of different conductivity for conducting said current.

12. The accelerator as claimed in claim 10, wherein said means for establishing an inductance comprises coil sectors having different numbers of turns for conducting said current.

* * * * *

UNITED STATES PATENT AND TRADEMARK OFFICE

CERTIFICATE OF CORRECTION

PATENT NO. : 4,870,888

DATED : October 3, 1989

INVENTOR(S) : William F. Weldon & Mircea D. Driga

It is certified that error appears in the above-identified patent and that said Letters Patent is hereby corrected as shown below:

Title page:

In the Abstract, line 6, please change "to the" to --to a--.

In Col. 1, line 38, please change "ar" to --are--.

In Col. 1, line 46, before "In", please insert ".".

In Col. 2, line 9, after "railguns", please insert ".".

In Col. 6, line 13, please change "TABLE II" to --TABLE I--.

In Col. 8, line 64, please change "$R_g$," to --$R_g$'--.

In Col. 10, line 54, please delete "steps".

In Col. 11, line 2, please change "steps" to --stage--.

In Col. 12, lines 1-2, please change "resistance" to --resistances--.

In col. 12, line 35, please change "resistance" to --resistive--.

Signed and Sealed this

Fourth Day of September, 1990

*Attest:*

HARRY F. MANBECK, JR.

*Attesting Officer*

*Commissioner of Patents and Trademarks*